United States Patent [19]

Ogawa et al.

[11] Patent Number: 5,054,199

[45] Date of Patent: Oct. 8, 1991

[54] HAIR CUTTER

[75] Inventors: Hitoshi Ogawa, Hikone; Shoji Fujikawa, Ishibe, both of Japan

[73] Assignee: Matsushita Electric Works, Ltd., Japan

[21] Appl. No.: 623,065

[22] Filed: Dec. 6, 1990

[30] Foreign Application Priority Data

Dec. 25, 1989 [JP] Japan ..... 1-335469

[51] Int. Cl.[5] ..... B26B 19/00; B26B 19/02; B26B 19/12; B26B 19/10

[52] U.S. Cl. ..... 30/34.1; 30/200; 30/210; 30/216

[58] Field of Search ..... 30/34.1, 34.2, 43.1, 30/42, 43, 200, 210, 216, 123

[56] References Cited

U.S. PATENT DOCUMENTS

| | | | |
|---|---|---|---|
| 4,283,848 | 8/1981 | Messinger et al. | 30/34.1 |
| 4,393,585 | 7/1983 | Nagelkerke | 30/34.1 |
| 4,614,036 | 9/1982 | Haraguchi | 30/200 |
| 4,776,095 | 10/1988 | Tsujimoto et al. . | |
| 4,845,847 | 7/1989 | Yasunaka et al. | 30/34.1 |

FOREIGN PATENT DOCUMENTS 63-158093 7/1988 Japan .

*Primary Examiner*—Frank T. Yost
*Assistant Examiner*—Paul M. Heyrana, Sr
*Attorney, Agent, or Firm*—Stevens, Davis, Miller & Mosher

[57] ABSTRACT

A motor-driven hair cutter is provided with a main cutter and a trimmer at a front end of an elongated housing. Each of the main cutter and the trimmer is a reciprocatory cutter comprising a toothed stationary blade and a toothed movable blade driven to reciprocate in hair shearing engagement with the stationary blade. The trimmer is movable between a retracted position in which a cutting edge of the trimmer is behind a cutting edge of the main cutter and a projected position in which the cutting edge of the trimmer projects forwardly of the main cutter so that the trimmer alone can be used. The trimmer blades are formed to be smaller in thickness as well as in cutting edge width than those of the main cutter blades in order to facilitate a delicate trimming of hairs in a restricted area of a user's head by the trimmer.

5 Claims, 8 Drawing Sheets

50
80
85
43
10
70
14
73
84
90
17

50
80
83
70
14
73
85
84
90
17
10

70
89
80
85
50
73
84
90
17
83
82
10

HAIR CUTTER

BACKGROUND OF THE DISCLOSURE

1. Field of the Invention

The present invention relates to a power-driven hair cutter provided with a trimmer in addition to a main cutter.

2. Description of the Prior Art

Power-driven hair cutters are well-known in the art such as proposed by the applicant in U.S. Pat. No. 4,776,095. The hair cutter has a main cutter designed to chiefly effect the cutting of the hairs to a desired length and is not capable of trimming hairs or the margin of the hairs delicately particularly at a restricted area. Therefore, it is required to use additional razor or dry shaver in order to finish the margin of the hairs to a desired style. In this regards, two different hair cutting and trimming devices are necessitated in order to complete a hair styling including the hair cutting and trimming, which is very inconvenient for the user.

To avoid the above inconvenience, there has been proposed by the applicant a combination hair cutter, which is disclosed in the Japanese Non-Examined Patent Publication [KOKAI] No. 63-158093 to have main cutter head 1 composed of an arcuately shaped shearing foil and an inner cutter, as well as a trimmer 2 composed of two flat blades, as schematically shown in FIGS. 9 and 10, in order to selectively effect the hair cutting and trimming with the single cutter device. However, because of that the trimmer 2 is designed to have cutter edge width as well as blade thickness greater than those of the main cutter or the shearing foil thereof, it is rather difficult to manipulate the trimmer in restricted areas to which the fine trimming is mostly required. Because of the inconvenience, the prior art combination hair cutter is not successful and fails to meet the combination hair cutting and trimming requirements, particularly for delicate trimming of complicated margin of the hairs in the restricted area with the single device.

SUMMARY OF THE INVENTION

To eliminate the above problem, the present invention provides unique combination hair cutter with a main cutter and a trimmer. The hair cutter in accordance with the present invention comprises an elongated housing having a longitudinal axis and provided at its front end with the main cutter and the trimmer. The main cutter comprises a toothed stationary blade and a toothed movable blade driven by a rotary motor to reciprocate in a hair shearing engagement with the stationary blade. The blades are cooperative with one another to define a main cutting edge arranged along the front end of the housing. The trimmer comprises a toothed stationary trimmer blade and a toothed movable trimmer blade driven by the common rotary motor to reciprocate in a hair shearing engagement with the stationary trimmer blade. The trimmer blades are cooperative with one another to define a trimmer edge directed forwardly of the housing and arranged in a parallel relation to the main cutting edge. The trimmer is movable along the longitudinal axis of the housing between a retracted position where the trimmer edge is behind the main cutting edge and a projected position where the trimmer edge projects forwardly beyond the main cutting edge. The trimmer blades are formed to be smaller in thickness as well as in cutting edge width than those of the main cutter blades such that the trimmer in its projected position can go through into a restricted area due to the reduced cutting edge width and can effect fine or delicate hair trimming due to the reduced blade thickness.

Accordingly, it is a primary object of the present invention to provide a motor-driven hair cutter which is capable of successfully effecting fine hair trimming in a restricted area in addition to the normal hair cutting with a single cutter device.

In a preferred embodiment, the trimmer blades define therebetween a trimmer cutting plane lying in a general top plane of the housing and the main cutter blades are cooperative to define therebetween a cutting plane which is inclined with respect to the housing longitudinal axis such that the main cutting edge comes close to the trimmer cutting plane in an adjacent relation to the trimmer cutting edge in the projected position. With this arrangement, the user can manipulate the main cutter and the trimmer at substantially the same position at the top front end of the housing in a like fashion, which enhances the convenience of using the main cutter and the trimmer.

It is therefore another object of the present invention to provide a hair cutter in which the hair cutting and trimming can be made at the like position relative to the housing to enhance the manipulation convenience.

The trimmer is supported on a trimmer handle to be movable therewith between the retracted and projected positions. The trimmer handle is slidably mounted on the top of the housing through a turn-over spring which applies a biasing force of urging the trimmer handle toward the projected position after the trimmer handle is manipulated to move out of the retracted position by a slight distance. The trimmer handle is latched into the projected position to be stable thereat the for trimming operation. For shifting of the trimmer into the projected position, the user is only required to move the trimmer handle out of the retracted position by a slight distance, after which the turn-over spring acts to urge the trimmer handle into the projected position without further requiring the user to apply a force.

Therefore, it is a further object of the present invention to provide a hair cutter in which the trimmer can be easily manipulated into the projected position for trimming operation.

The rotary motor is accommodated within the housing and has an output rotor shaft extending along the longitudinal axis of the housing. The output rotor shaft is drivingly connected through first and second drive elements to drive the main cutter and the trimmer. The first drive element includes an eccentric shaft and an eccentric cam both eccentric to the output rotor shaft. The eccentric shaft extends into a slot formed at the main movable blade to thereby translate a rotary motion of the eccentric shaft into a reciprocating motion of the main movable blade. The second drive element is supported within the housing to be movable in a transverse direction perpendicular to an axis of the rotor shaft, and is engaged with the eccentric cam of the first drive element in such a manner as to translate a rotary motion thereof into a reciprocating motion of the second drive element. The second drive element is provided with a joint pin for engagement with the trimmer movable blade for reciprocation thereof. Therefore, the second drive element for the trimmer can be connected to the common drive source simply by the addition of the eccentric cam to the first drive element and without requiring further complicated parts. In this sense, the main cutter and the trimmer can be driven by the same motor through a simple rotary-to-oscillation conversion mechanism, which is therefore a still further object of the present invention.

Additionally, the housing is formed at it top forward edge with a hair smoothing comb arranged along the main cutting edge in juxtaposed relation therewith. The comb having its leading edge positioned rearwardly of the main cutting edge for guiding the clipped hairs smoothly away from the main cutting edge. Thus, the clipped hairs can be smoothly excluded from the cutting edge so as not to remain accumulated around the cutting edge and not to interrupt the subsequent hair cutting.

It is therefore a still further object of the present invention to provide a hair cutter which is capable of smoothly guiding the hairs past the main cutting edge by the comb formed immediately behind the cutting edge.

These and still other objects and advantageous features of the present invention will become more apparent from the following description of the preferred embodiment when taken in conjunction with the attached drawings.

DETAILED DESCRIPTION OF THE PREFERRED EMBODIMENT

Figure 1:
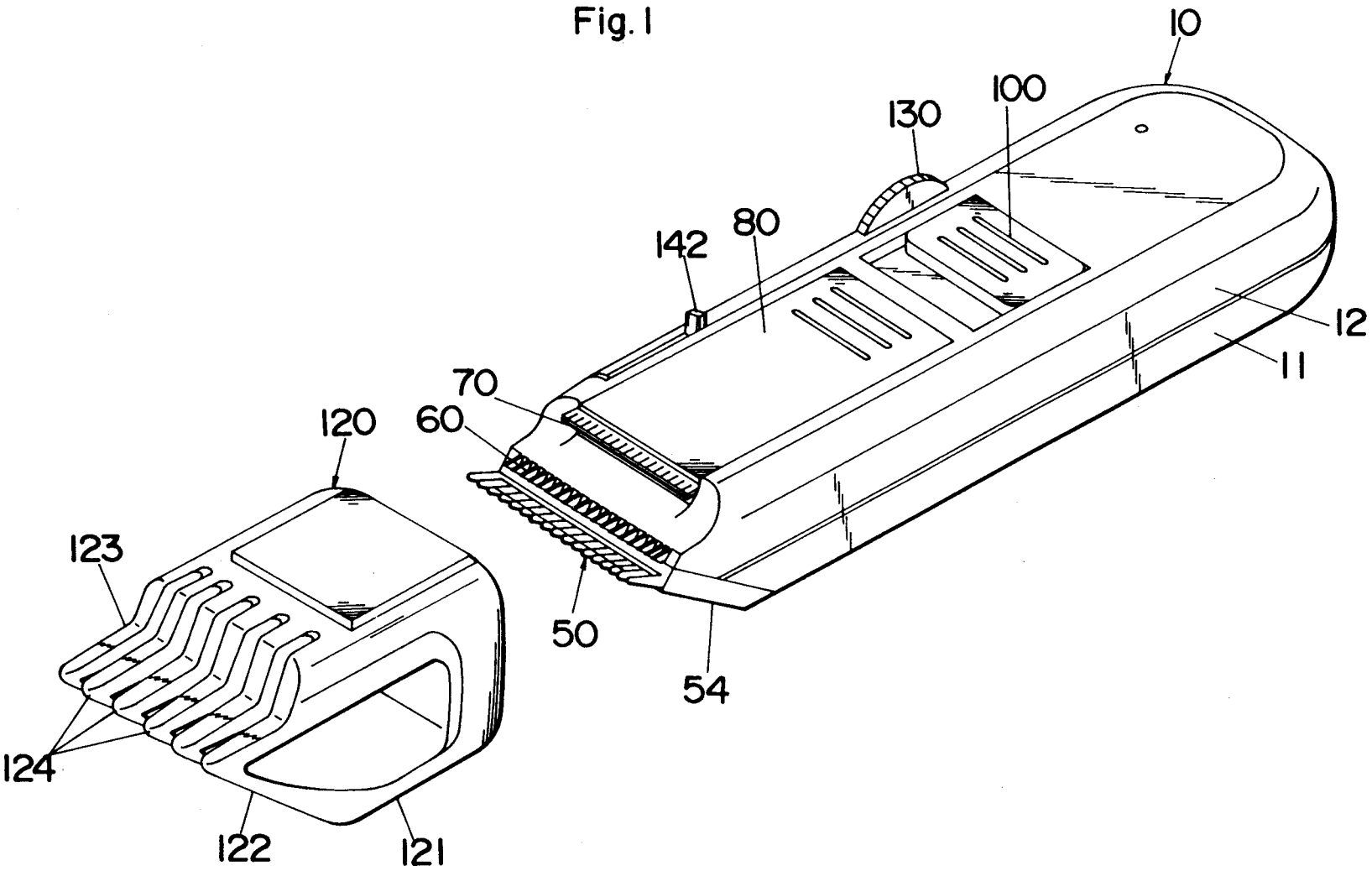
FIG. 1 is a perspective view of a hair cutter in accordance with a preferred embodiment of the present invention.
Figure 2:
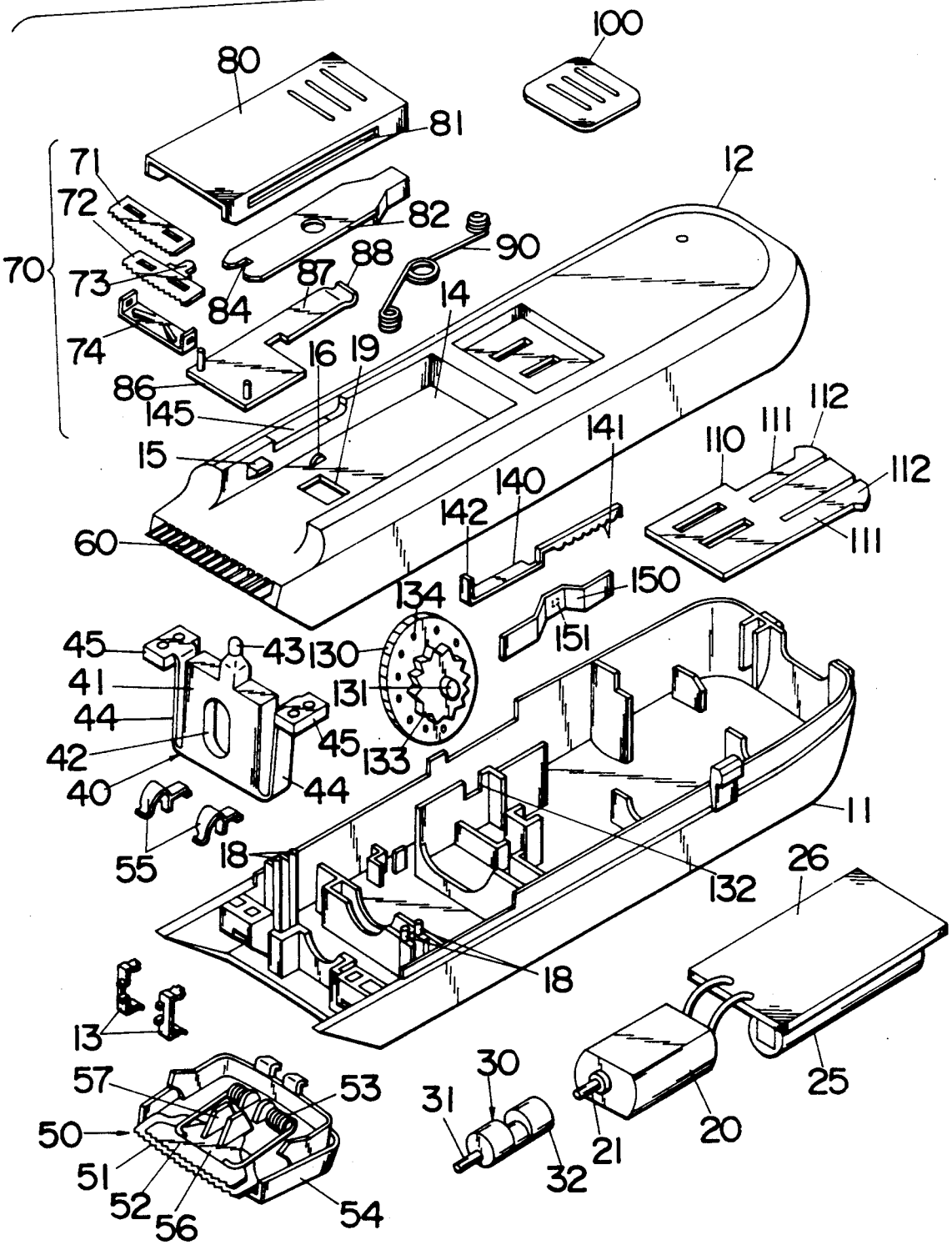
FIG. 2 is an exploded perspective view of the hair cutter.
Figure 3:
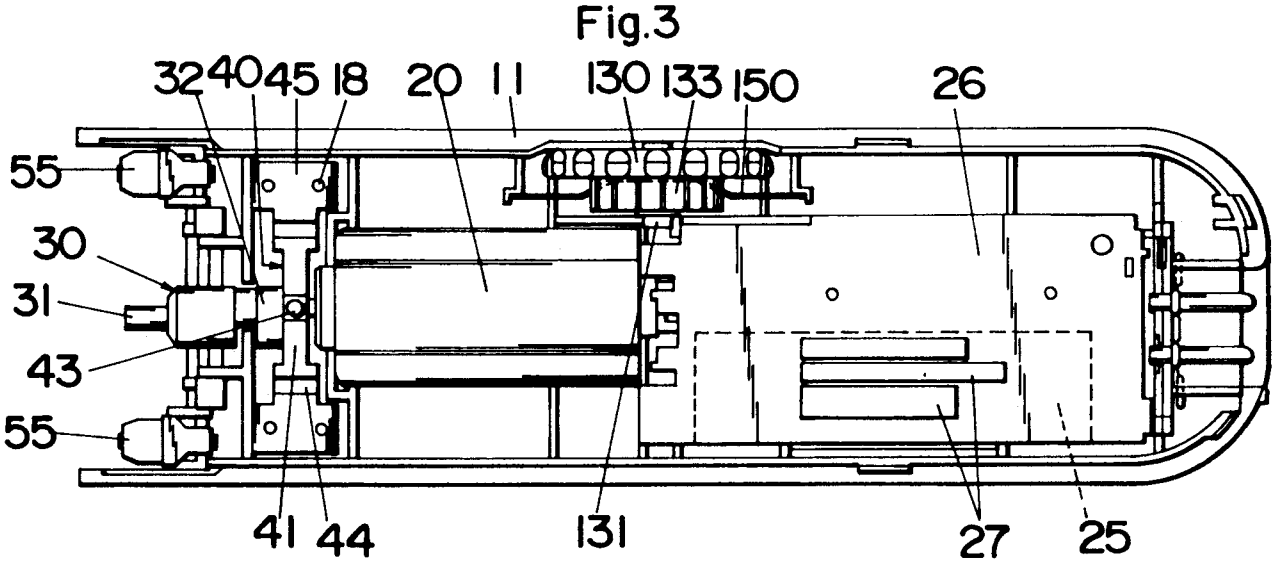
FIG. 3 is an inside view of a lower half of the housing.
Figure 4:
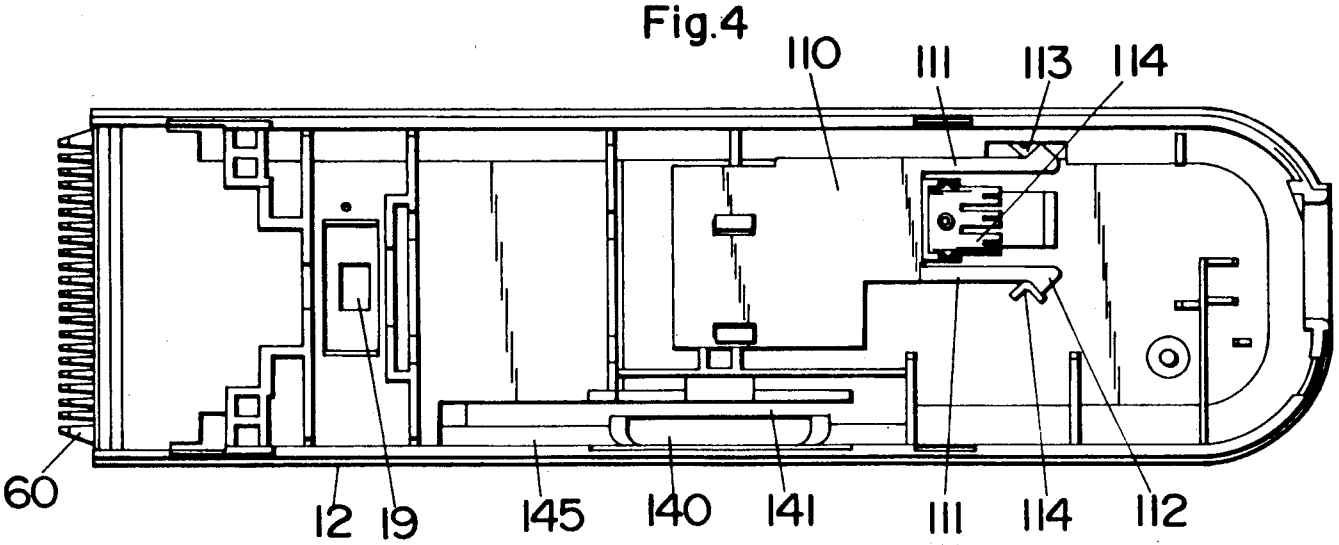
FIG. 4 is an inside view of an upper half of the housing.

Referring now to FIGS. 1 to 4, there is illustrated a hand-held electric hair cutter in accordance with a preferred embodiment of the present invention. The hair cutter is chiefly designed for hair styling of mustache or beard into a desired finish by selective use of two different cutting units, i.e., a main cutter 50 and a trimmer 70 which are of the like blade configuration but are different in size or dimensions of the blades. The main cutter 50 and the trimmer 70 are mounted at the forward portion of an elongated housing 10 to be grasped by one hand of the user. The housing 10 is composed of a lower half 11 and an upper half 12 which are in mating engagement and fastened together at the front end by mean of clips 13. Accommodated within the housing 10 is an electric rotary motor 20 for driving the main cutter 50 and the trimmer 70. The motor 20 is energized by a rechargeable battery 25 supported on a circuit board 26 which forms thereon a charging and energizing circuit and is accommodated within the housing 10 rearwardly of the motor 20. The motor 20 has an output rotor shaft 21 which is drivingly connected through first and second drive elements 30 and 40 to drive the main cutter 50 and the trimmer 70. As shown in FIGS. 2 and 3, the first drive element 30 is coupled at its rear end to the motor output rotor shaft 21 and is provided with an eccentric shaft 31 and an eccentric cam 32 which are disposed axially in eccentric relation to the output rotor shaft 21.

The main cutter 50 comprises a toothed stationary blade 51 and a toothed movable blade 52 which is spring-biased by means of a torsion spring 53 against the stationary blade 51 in hair shearing engagement therewith. The blades 51 and 52 are supported on a head plate 54 detachably mounted to the front end of the housing lower half 11 by means of clasps 55 in such a manner that a cutting plane defined between the blades 51 and 52 is inclined with respect to the longitudinal axis of the housing 10 and that a cutting edge projects slightly beyond the forward top end of the housing 10. Provided at the rear portion Of the movable blade 52 away from the cutting edge is a drive plate 56 with a vertical slot 57 into which the eccentric shaft 31 of the first drive element 30 extends such that a rotary motion of the motor output shaft 21 is translated into a reciprocatory motion of the movable blade 52 relative to the stationary blade 51. At the forwardmost end of the housing upper half 12 immediately behind the cutting edge of the main cutter 50, there is formed a comb 60 of which teeth are spaced at the same interval as the teeth of the stationary blade 51 and arranged in registration therewith such that the hairs just clipped at the main cutter edge can be smoothly guided through the comb 60 away from the cutting edge to prevent the cutting edge from being clogged by the clipped hairs and therefore expedite continuous hair cutting.

Figure 5:
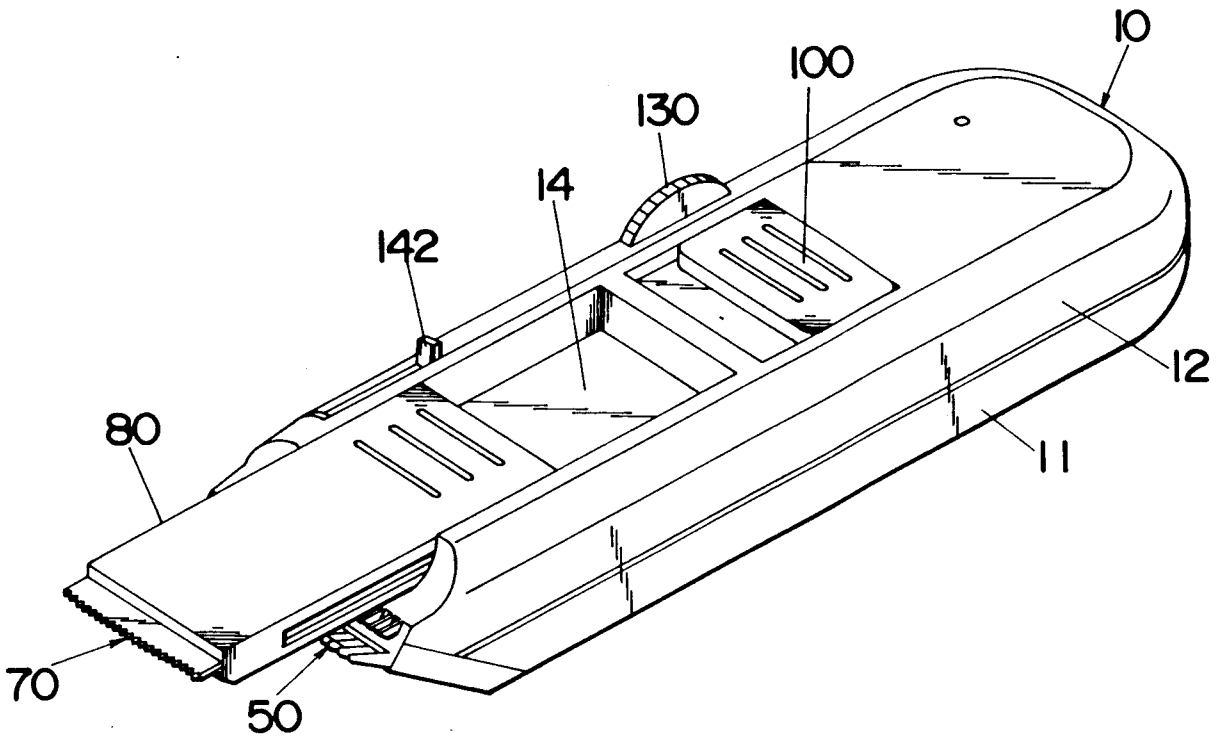
FIG. 5 is a perspective view of the hair cutter shown with a trimmer in a projected position.
Figures 6A, 6B, 6C:
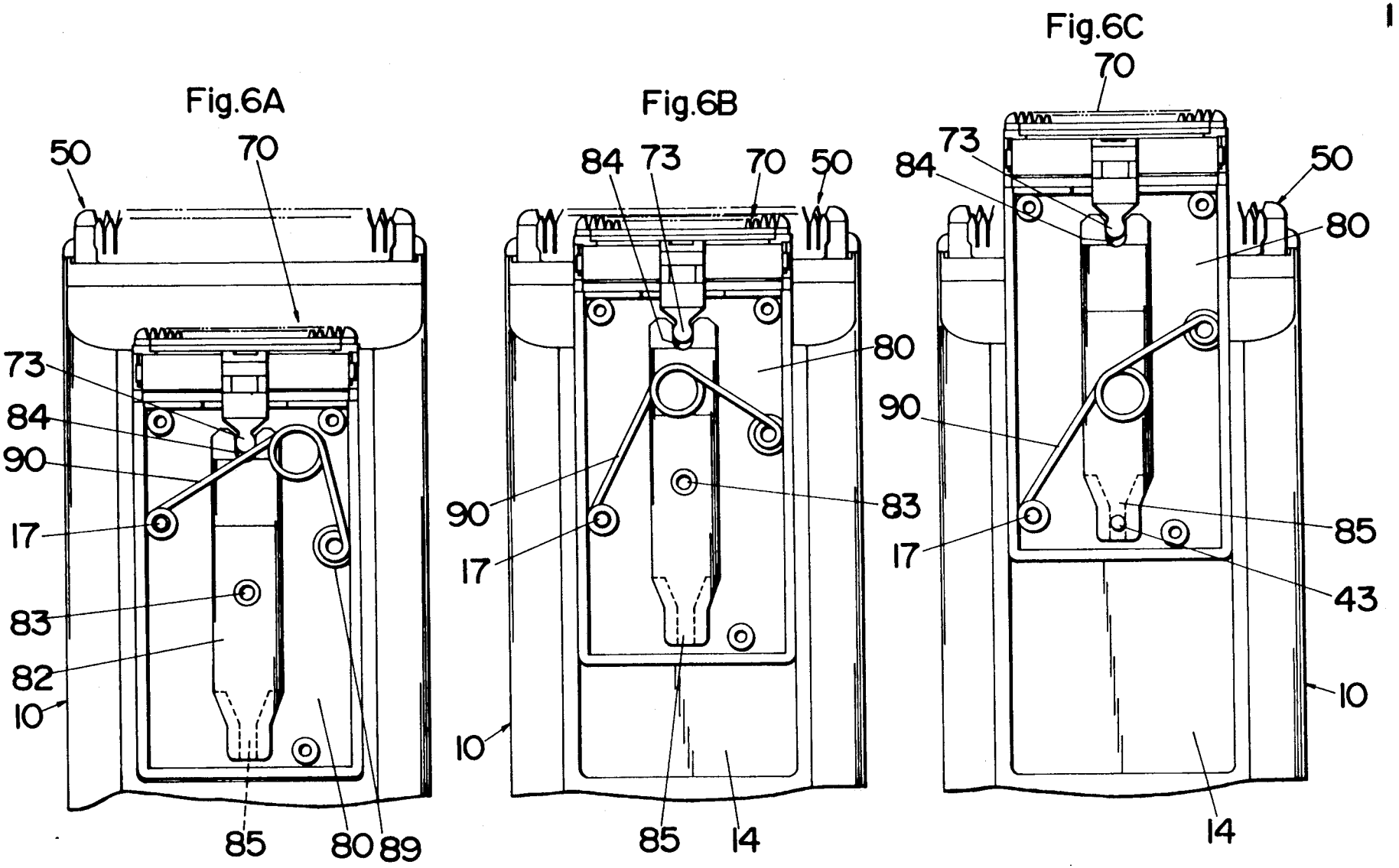
FIGS. 6A to 6C are views illustrating the shifting of a trimmer blade from a retracted position through an intermediate position to the projected position.

The trimmer 70 comprises a toothed stationary blade 71 and a toothed movable blade 72 which are held in hair shearing engagement between the toothed edges and are supported on a front end of a flat shaped rectangular trimmer handle so as to project its cutting edge forwardly of the handle so and to define between the blades 71 and 72 a cutting plane lying substantially in the plane of the handle 80. The trimmer handle 80 is slidably fitted within a shallow recess 14 in the upper surface of the housing upper half 12 so as to be movable between a retracted position where the trimmer cutting edge is behind the comb 60, as shown in FIG. 1, and a projected position where the cutting edge projects forwardly of the cutting edge of the main cutter 50, as shown in FIG. 5, by a amount such that the trimmer can be alone utilized without being interrupted by the main cutter. For the slidable mounting of the trimmer handle 80, rail projections 15 on the sides of the recess 14 extend respectively into grooves 81 in depending side walls of the trimmer handle 8O. Provided on the undersurface of the trimmer handle 80 is a rocker 82 connected between the second drive element 40 and the movable blade 72 The rocker 82 is pivoted at its middle to a stud 83 on the underside of the handle so, as shown in FIGS. 6A to 6C, and is connected at its forward end 84 to a finger 73 at the rear end of the movable blade 72. At the rear end of the rocker 82 there is formed a catch 85 for coupling with the second drive element 40. A bottom cover 74 with integral spring leaves is fitted over the movable spring 73 to urge the movable blade 72 against the stationary blade 71 in hair shearing engagement A bottom plate 86 fitted in the bottom of the handle 80 has a spring extension 87 with a latch end 88 which comes into latching engagement with a projection 16 on the bottom of the recess 14 when the trimmer handle 80 is in the projected position for retaining the handle 80 at this position.

Connected between the trimmer handle 80 and the housing upper half 12 is a turn-over spring 90 which is in the form of a torsion spring with coiled ends at the free ends of two arms and which applies a biasing force to expedite the sliding movement of the handle 80 between the retracted and projected positions. As shown in FIGS. 6A to 6C, one of the coiled ends is fitted in a pocket 89 formed in the lower surface of the trimmer handle 80 at a position adjacent one lateral side and intermediate the length thereof, while the other coiled end is engaged with a post 17 projecting on the bottom of the recess 14 at a position adjacent one side edge and intermediate the length thereof in such a manner that the turn-over spring 90 is compressed at the retracted position of the trimmer handle 80 of FIG. 6A and is expanded at the projected position of FIG. 6C. At the retracted position of FIG. 6A, the turn-over spring 80 is kept compressed to exert a spring force of urging the trimmer handle 80 rearwardly for retaining it in this position by abutment of the rear end of the handle so against the rear end wall of the recess 14. When the trimmer handle so is manipulated to move out of the retracted position of FIG. 6A by a slight extent to a position of FIG. 6B past a turning point where the turn-over spring 90 is most compressed, the turn-over spring 90 is then allowed to expand to thereby bias the handle 80 in the forward direction. After the handle 80 is manipulated to move to the position of FIG. 6B, the handle 80 is therefore forced by the spring 90 to move to the projected position of FIG. 6C without the need of further manipulating the handle 80 by the hand of the user. Accordingly, the trimmer handle 80 can be shifted to the projected position over a long stroke from the retracted position simply by manipulating it out of the retracted position by a slight distance.

The second drive element 40 for reciprocating the trimmer movable blade 72 is, as shown in FIGS. 2 and 3, of a unitary construction comprising a rigid center member 41 with a vertically elongated bearing hole 42 and an upstanding joint pin 43 on top of the member 41. Resilient legs 44 of reduced thickness extend upwardly from the lower side ends of the member 41 and terminate respectively at anchor ends 45 of increased thickness which are fixed to the housing lower half 11 by engaging spikes 18 into corresponding holes in the anchor ends 45. Thus, the center member 41 is mounted in the housing 10 so as to be movable in the lateral direction perpendicular to the longitudinal axis of the housing 10 as the resilient legs 44 flex. The bearing hole 42 receives the eccentric cam 32 of the first drive element 30 such that the rotary motion of the eccentric cam 32 or the motor 20 is translated into a reciprocatory motion of the center member 41. The joint pin 43 of the center member 41 extends through an opening 19 in the bottom of the recess 14 into engagement with the catch 85 at the rear end of the rocker 82 in the projected position of the trimmer handle 80 so as to drive the rocker 82 about its pivot axis to thereby reciprocate the trimmer movable blade 72. When the trimmer handle 80 is shifted out of the projected position, the joint pin 43 disengages from the catch 85, as shown in FIGS. 6A and 6B, so that the trimmer is not operated in such position.

A switch handle 100 is mounted on the top of the housing upper half 12 rearwardly of the trimmer handle 80 as being coupled to an actuator plate 110 on the underside of the housing upper half 12. The actuator plate 110 includes a pair of resilient legs 111 with latch projections 112 which are engageable with corresponding cam projections 113 on the inner bottom of the housing upper half 12 so as to latch the actuator plate 110 or the switch handle 100 in either of two longitudinal spaced ON and OFF positions. At the ON position, a contact 114 on the rear of the actuator plate 110 conducts between lines 27 on the circuit board 26 to energize the motor. Otherwise, the contact 114 is away from the lines 27 to disconnect the lines 27 for deenergization of the motor 20.

Figure 7:
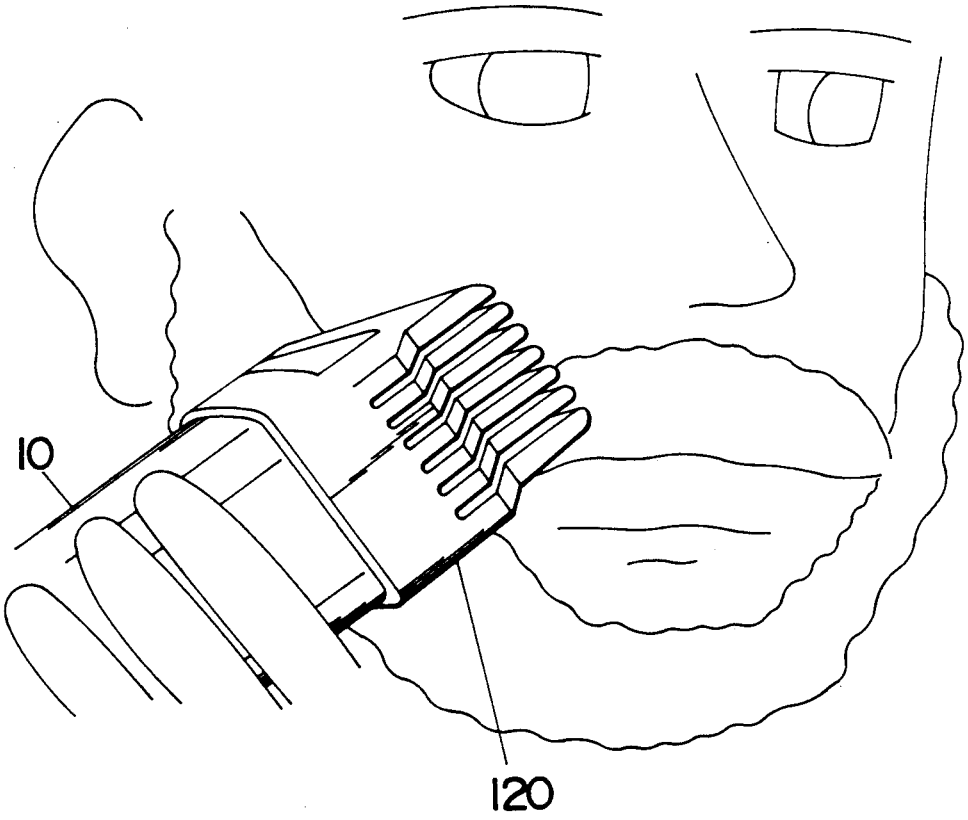
FIG. 7 is a schematic view illustrating a typical use of the hair cutter for hair cutting with a comb attachment.

A detachable comb attachment 120 is slidably fitted over the front end of the housing 10 to be movable in the longitudinal direction thereof. The comb attachment 120 is shaped into a cap-like configuration with a rear opening into which the front end of the housing 10 fits. The front portion of the comb attachment 120 has a flat bottom surface 121, an inclined front surface 122, and a stepped top surface 123, which portions are slotted to form a number of comb fins 124 spaced evenly along the cutting edge of the main cutter 50 at a distance greater than the pitch of the blades 51 and 52. In use, the inclined top surface 122 is in guiding contact with the skin surface of the user, as shown in FIG. 7, to keep the main cutting edge at a fixed distance from the skin, thereby assuring to cut the hairs to a predetermined length while advancing the cutting edge across the skin surface, during which the hairs are smoothed by the comb fins 124 prior to reaching the main cutting edge 50 for successfully cutting twisted or entangled hairs. Since the comb attachment 120 is slidable along the length of the housing 10, it is easy to vary the distance between the inclined top surface and the cutting edge for adjustment of the cutting length of the hair. To facilitate the adjustment, an operator dial 130 is connected to the comb attachment 120 through a linkage bar 140 to effect sliding movement of the comb attachment 120 by rotating the operator dial 130 by the finger of the user grasping the housing 10. The dial 130 is mounted on and partly within the housing 10 with its center axis 131 journaled in a notch 132 in the housing lower half 12. A pinion 133 are integrally and concentrically formed around the center axis 131 for engagement with a rack 141 at the rear of the linkage bar 140. The linkage bar 140 extends in the housing 10 along one side thereof and is formed at its front end with a hook 142 which projects out of a slot 145 in the housing upper half 12 for detachable engagement with a corresponding dent (not shown) in the rear inner surface of the comb attachment 120. A click spring 150 with a ball projection 151 is fitted adjacent the dial 130 such that the ball projection 151 is spring-biased into any one of detent pits 134 circumferentially spaced in the dial 130 for positively retaining the dial 130 or the comb attachment 120 at a desired position.

Figure 8:
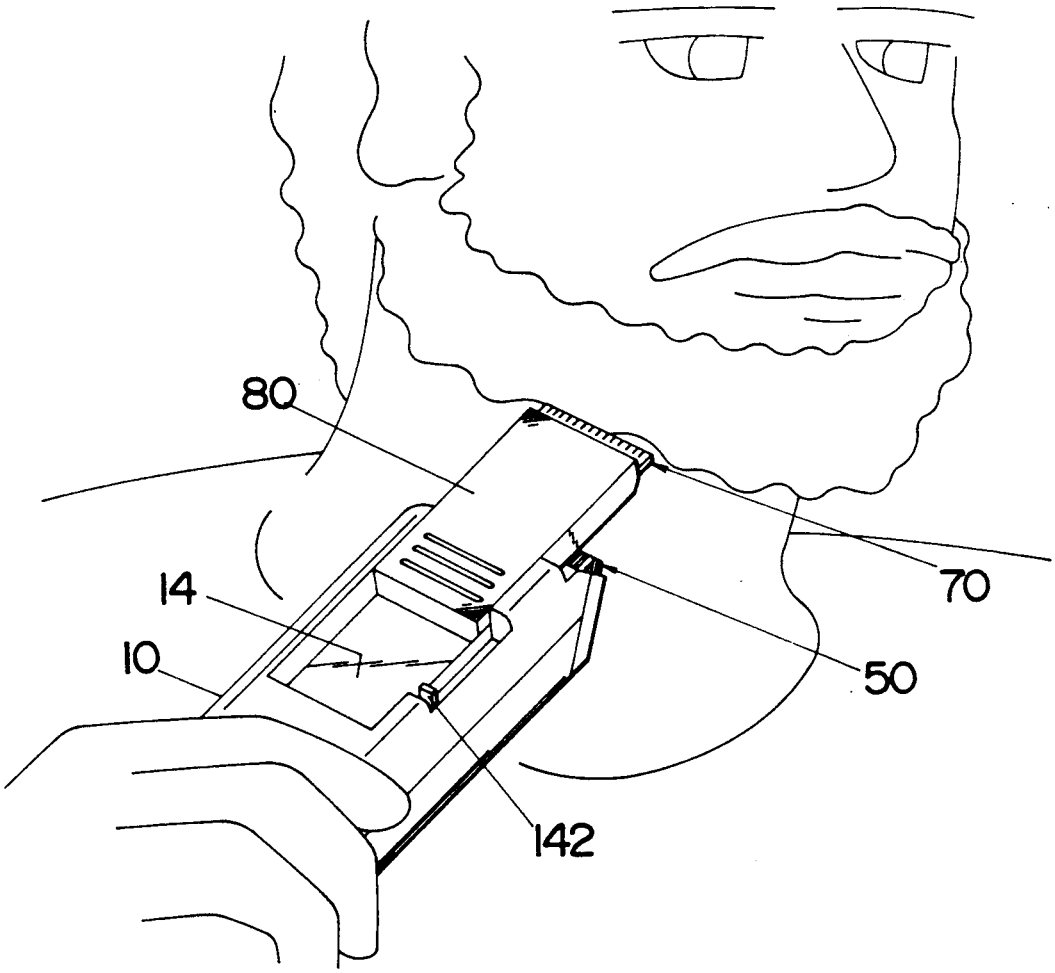
FIG. 8 is a schematic view illustrating a typical use of the hair cutter for hair trimming with a trimmer in the projected position.
Figure 9:
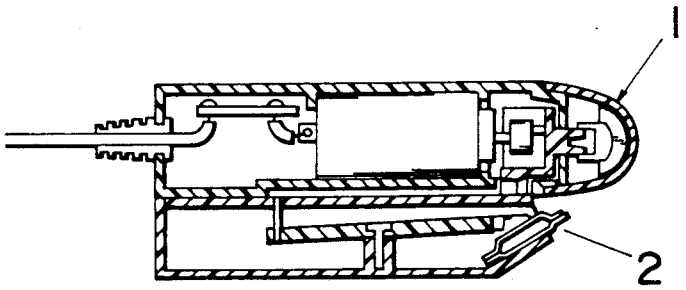
FIG. 9 and FIGS. 10A to 10C are schematic views of a prior art combination hair cutter and trimmer.
Figure 10A:
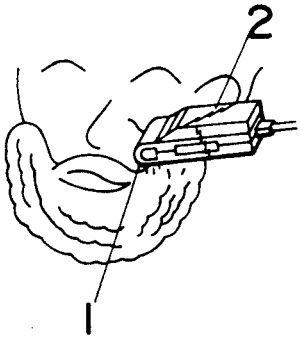
Figure 10B:
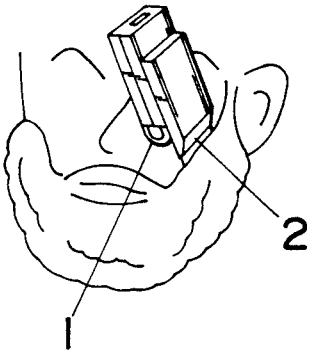
Figure 10C:
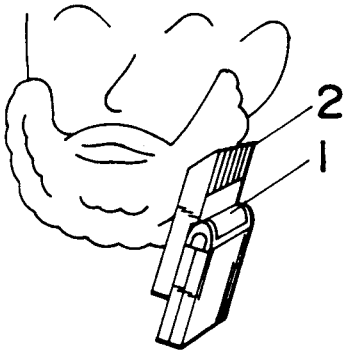

When the hair cutter is utilized for trimming the hairs, the trimmer handle so is manipulated into the projected position, as shown in FIG. 8, so that the trimmer cutting edge projects beyond the main cutting edge for trimming of hairs at the trimmer cutting edge substantially free from the main cutting edge. It should be noted at this time that the cutting edge width as well as the blade thickness of the trimmer 70 is less than those of the main cutter 50. Therefore, the trimmer cutting edge is allowed to advance in a restricted area where it is difficult for the main cutting edge to reach as well as to effect fine trimming or cutting, whereby assuring a skillful trimming in conformity to a delicate hair styling requirement.

What is claimed is:

1. A power-driven hair cutter comprising:

an elongated housing having a longitudinal axis;

a main cutter mounted at a front end of said housing and comprising a toothed stationary blade and a toothed movable blade driven by motor means in said housing to reciprocate in a hair shearing engagement with said stationary blade, said blades being cooperative with one another to define a main cutting edge arranged along the front end of said housing;

a trimmer mounted on said housing and comprising a toothed stationary trimmer blade and a toothed movable trimmer blade driven by said motor means to reciprocate in a hair shearing engagement with said stationary trimmer blade, said trimmer blades being cooperative with one another to define a trimmer edge directed forwardly of said housing and arranged substantially in a parallel relation to said main cutting edge, said trimmer movable along said longitudinal axis of said housing between a retracted position where said trimmer edge is behind said main cutting edge and a projected position where said trimmer edge projects forwardly beyond said main cutting edge;

said trimmer blades being formed to be smaller in thickness as well as in cutting edge width than those of said main cutter blades.

2. A hair cutter as set forth in claim 1, wherein said trimmer blades define therebetween a trimmer cutting plane lying in a general top plane of said housing, and said main cutter blades are cooperative to define therebetween a cutting plane which is inclined with respect to said longitudinal axis of said housing such that said main cutting edge comes close to said trimmer cutting plane in an adjacent relation to the trimmer cutting edge in its projected position.

3. A hair cutter as set forth in claim 1, wherein said trimmer is supported on a trimmer handle by which it is movable between said retracted and projected positions, said trimmer handle being slidably coupled to said housing through a turn-over spring which applies a biasing force of urging said trimmer handle toward said projected position after said trimmer handle is manipulated to move from said retracted position to a slight extent, said hair cutter further including means for latching said trimmer handle into said projected position.

4. A hair cutter as set forth in claim 1, wherein said motor means comprises:

an electric rotary motor with an output rotor shaft extending along said longitudinal axis of the housing;

a first drive element drivingly connected to said output rotor shaft, said first drive element including an eccentric shaft and an eccentric cam both eccentric to said output rotor shaft, said eccentric shaft extending into a slot formed at said main movable blade to thereby translate a rotary motion of the eccentric shaft into a reciprocating motion of said main movable blade; and a second drive element supported within said housing to be movable in a transverse direction perpendicular to said longitudinal axis, said second drive element being engaged with said eccentric cam in such a manner as to translate a rotary motion thereof into a reciprocating motion of said second drive element, said second drive element provided with a joint pin for engagement with said trimmer movable blade for reciprocation thereof.

5. A hair cutter as set forth in claim 2, wherein said housing is formed at it top forward edge with a hair smoothing comb arranged along said main cutting edge in juxtaposed relation therewith, said comb having its leading edge positioned rearwardly of said main cutting edge and having teeth spaced by substantially the same distance as those of said main stationary blade.

* * * * *